US012546570B2

(12) United States Patent
McCloy

(10) Patent No.: US 12,546,570 B2
(45) Date of Patent: Feb. 10, 2026

(54) FIREARM OPTICS MOUNT

(71) Applicant: Michael Walter McCloy, Gardendale, AL (US)

(72) Inventor: Michael Walter McCloy, Gardendale, AL (US)

(73) Assignee: McCloy Implement, LLC, Athol, ID (US)

( * ) Notice: Subject to any disclaimer, the term of this patent is extended or adjusted under 35 U.S.C. 154(b) by 0 days.

(21) Appl. No.: 18/920,179

(22) Filed: Oct. 18, 2024

(65) Prior Publication Data

US 2025/0224211 A1 Jul. 10, 2025

Related U.S. Application Data

(63) Continuation of application No. 17/558,188, filed on Dec. 21, 2021, now Pat. No. 12,169,116.

(51) Int. Cl.
*F41G 11/00* (2006.01)

(52) U.S. Cl.
CPC ..... *F41G 11/003* (2013.01)

(58) Field of Classification Search
CPC ..... F41G 11/003
See application file for complete search history.

(56) References Cited

U.S. PATENT DOCUMENTS 1,000,145 A * 8/1911 Bennett ..... F41G 11/003 42/124
2,367,762 A * 1/1945 Eiane ..... F41G 1/033 42/148
3,226,868 A * 1/1966 Mahoney ..... F41G 11/008 42/128
3,737,232 A * 6/1973 Milburn, Jr. ..... G02B 23/14 356/18
3,961,423 A * 6/1976 Hrebar ..... F41G 1/00 42/137
4,348,716 A * 9/1982 Storm ..... F41G 1/35 362/202
5,606,818 A * 3/1997 Hardee ..... F41G 11/003 42/127
6,338,219 B1 * 1/2002 Watson, Jr. ..... F41G 1/08 42/130
7,900,390 B2 * 3/2011 Moody ..... F41A 23/08 42/71.01
7,908,782 B1 * 3/2011 LaRue ..... F41G 11/008 42/124

(Continued)

*Primary Examiner* — Michelle Clement
(74) *Attorney, Agent, or Firm* — AdamsIP, LLC; Edward Brinkley Garner, III; Joseph Andrew Vaccaro

(57) ABSTRACT

A firearm optics mount is configured to position an optic device on a firearm in a position offset from vertical alignment above the barrel when the firearm is in the vertical position. The canted mount includes a base, a support, and an optic mount at the end of the support. The support is configured to offset the optic between 5 and 30 degrees from vertical alignment with the barrel when the firearm is vertically positioned. The support may be configured to offset the optic between 12 and 22 degrees. The base of the mount may include a rear sight. The optic mounted to the firearm via the canted mount may be a primary or only optic of the firearm. The mount may vertically align a bullet drop feature of an optic with the centerline of the barrel when the firearm is canted to position the optic vertically above the barrel.

20 Claims, 9 Drawing Sheets

(56) References Cited

U.S. PATENT DOCUMENTS 7,954,273 B1 * 6/2011 Swan ..... F41G 1/35 42/117
8,104,218 B2 * 1/2012 McCann ..... F41G 1/033 42/144
D663,006 S * 7/2012 Storch ..... D22/108
8,215,046 B2 * 7/2012 Chvala ..... F41C 23/16 42/72
8,424,234 B2 * 4/2013 Carlson ..... F41G 11/001 42/90
8,468,735 B1 * 6/2013 Keng ..... F41G 1/08 42/148
8,510,983 B2 * 8/2013 Larue ..... F41G 11/003 42/124
8,726,562 B1 * 5/2014 Hoskisson ..... F41G 11/003 42/126
D713,921 S * 9/2014 Williams ..... D22/109
D715,393 S * 10/2014 Williams ..... D22/109
D718,833 S * 12/2014 Huang ..... D22/108
RE45,724 E * 10/2015 Dueck ..... F41G 1/02
9,441,915 B2 * 9/2016 Zimmer ..... F41G 11/001
9,453,707 B2 * 9/2016 Williams ..... F41G 1/387
9,488,446 B2 * 11/2016 Zimmer ..... F41G 1/02
10,030,935 B1 * 7/2018 Ding ..... F41G 1/17
10,088,277 B2 * 10/2018 Zimmer ..... F41G 11/003
10,627,191 B1 * 4/2020 Fischer ..... F41G 11/008
10,627,192 B1 * 4/2020 Fischer ..... F41G 11/008
10,634,456 B1 * 4/2020 Fischer ..... F41G 11/003
10,670,374 B2 * 6/2020 Storch ..... F41C 27/00
11,060,815 B1 * 7/2021 Novak ..... F41C 27/00
11,067,365 B2 * 7/2021 Roberson ..... F41G 1/16
11,125,530 B2 * 9/2021 Kincel ..... F41C 23/16
11,262,168 B1 * 3/2022 Morse ..... F41G 3/165
11,365,954 B2 * 6/2022 Gerber ..... F41G 11/003
11,385,026 B2 * 7/2022 Roberson ..... F41G 11/001
11,435,163 B2 * 9/2022 Roberson ..... F41G 11/003
11,474,337 B2 * 10/2022 Brown ..... G02B 27/34
11,680,776 B2 * 6/2023 Nielsen ..... F41G 11/003 42/124
12,025,407 B2 * 7/2024 Itshaky ..... F41G 11/008
12,332,021 B2 * 6/2025 Teetzel ..... F41G 11/003
2004/0000083 A1 * 1/2004 Grant, Jr. ..... F41G 11/003 42/112
2006/0026888 A1 * 2/2006 Cheng ..... F41G 11/004 42/146
2007/0039225 A1 * 2/2007 Kallio ..... F41G 1/35 42/146
2008/0148619 A1 * 6/2008 Rogers ..... F41G 11/003 42/90
2009/0044439 A1 * 2/2009 Phillips ..... F41C 23/16 42/72
2009/0225557 A1 * 9/2009 Griffin ..... F41G 1/35 362/382
2010/0058640 A1 * 3/2010 Moore ..... F41G 1/36 42/114
2012/0060402 A1 * 3/2012 Dueck ..... F41G 1/02 42/137
2013/0036650 A1 * 2/2013 Larue ..... F41G 11/003 42/148
2014/0123532 A1 * 5/2014 Russ ..... F41G 1/38 42/113
2014/0137457 A1 * 5/2014 Collin ..... F41G 11/003 42/90
2014/0150324 A1 * 6/2014 Keng ..... F41G 1/30 42/118
2014/0190062 A1 * 7/2014 Turner, Jr. ..... F41G 11/003 42/124
2014/0196349 A1 * 7/2014 Rogers ..... F41G 1/35 42/90
2014/0259854 A1 * 9/2014 Williams ..... F41G 11/003 42/124
2014/0360077 A1 * 12/2014 Miller ..... F41C 27/00 42/84
2015/0040456 A1 * 2/2015 Zimmer ..... F41G 1/02 42/90
2016/0102941 A1 * 4/2016 Brucker ..... F41G 1/033 42/148
2016/0209176 A1 * 7/2016 Zimmer ..... F41G 11/001
2016/0320160 A1 * 11/2016 Zimmer ..... F41G 1/02
2018/0023924 A1 * 1/2018 Storch ..... F41C 27/00 42/90
2018/0073840 A1 * 3/2018 Kristoffersen ..... F41G 1/16
2018/0180386 A1 * 6/2018 Keller ..... F41G 1/065
2018/0195838 A1 * 7/2018 Storch ..... F41G 11/001
2020/0025522 A1 * 1/2020 Zimmer ..... F41G 11/001
2020/0041890 A1 * 2/2020 Peel ..... G03B 17/566
2020/0064102 A1 * 2/2020 Galli ..... H05B 45/00
2020/0132414 A1 * 4/2020 Shelton ..... F41G 11/003
2020/0271422 A1 * 8/2020 Ramirez ..... F41G 11/003
2020/0272044 A1 * 8/2020 Walker ..... F41G 11/003
2021/0055078 A1 * 2/2021 Roberson ..... F41G 1/16
2021/0262766 A1 * 8/2021 Roberson ..... F41G 11/001
2021/0348887 A1 * 11/2021 Connolly ..... F41G 11/008
2021/0372736 A1 * 12/2021 Zhou ..... F41G 1/35
2021/0372739 A1 * 12/2021 Nielsen ..... F41G 11/003
2022/0057172 A1 * 2/2022 Roberson ..... F41G 11/003
2022/0113114 A1 * 4/2022 Humphries ..... F41G 1/38
2023/0096361 A1 * 3/2023 Itshaky ..... F41G 11/008 42/90

* cited by examiner

FIREARM OPTICS MOUNT

RELATED APPLICATION

This application claims the benefit of priority under 35 U.S.C. § 119 to U.S. Non-Provisional patent application Ser. No. 17/558,188 entitled "FIREARM OPTICS MOUNT" filed Dec. 21, 2021, which claims priority to U.S. Provisional Patent Application Ser. No. 63/192,551 entitled "FIREARM OPTICS MOUNT" filed on May 24, 2021, which are incorporated herein in their entirety.

FIELD OF THE DISCLOSURE

This disclosure is generally related to a firearm optics mount that positions an optic device offset from vertical alignment above a barrel of the firearm.

BACKGROUND

Tactical police or military personnel often use a firearm such as, but not limited to a rifle, a short barreled rifle, or a pistol when entering a structure or confined area. The rifle may be, but is not limited, to an ARIS. The short barreled rifle may be, but is not limited to, a short barreled ARIS. The pistol may be, but is not limited, to an ARIS pistol. In such situations, using a scope located on the top rail of the firearm may not be practical due to the relatively short distances to possible targets. Often the firearm may be equipped with an optic adapted for short range such as a red dot sight or an advance combat optical gunsight (ACOG). The use of such optics typically blocks the line of sight between the rear iron sight and front iron sight on the firearm, if so equipped. This may be problematic in the event the optics becomes damaged and/or does not work properly.

Tactical personnel may be trained to always be looking through the optic while moving in a tactical situation, which may not always allow natural, comfortable, and/or ergonomical movements. For example, tactical personnel may typically be wearing a lot of gear including a helmet that may restrict or impede their freedom of motion. The gear may make it uncomfortable to move while always looking through the optic on the rifle.

Another potential encumbrance to the motion of tactical personnel is holding a rifle to the shoulder while moving. The tactical personnel must maintain the butt of the rifle against the end of humerus bone at the shoulder. The rounded nature of the shoulder may make holding the firearm uncomfortable and not optimal. Additionally, holding the firearm, such as a rifle, in a vertical position causes the user to draw in the user's elbows, which may not be optimal for balance of the user. The vertical position of the firearm, such as a rifle, short barreled rifle, or an ARI5 pistol is defined herein as the position when the top portion of the receiver of the firearm is in the same vertical plane as, and aligned with, the bottom portion of the firearm. In other words, in the vertical position the top of the receiver of the firearm is above the barrel of the firearm. If an accessory rail is attached to the receiver, the accessory rail is above the barrel of the firearm when the firearm is in the vertical position. Other disadvantages may exist.

SUMMARY

In an example, a firearm optics mount is configured to position an optic device on a firearm in a position offset from vertical alignment above a barrel of the firearm when the firearm is orientated with a top of the firearm being vertically aligned with a bottom of the firearm.

An embodiment of the disclosure is a mount configured to connect to a firearm. The mount includes a base and a support that extends away from the base and an optic mount at the end of the support. The support is configured to position an optic connected to the optic mount offset from vertical alignment with a barrel of the firearm when the firearm is in the vertical position. The support is configured to offset the optic between 5 degrees and 30 degrees from vertical alignment with the barrel of the firearm when the firearm is in the vertical position.

The optic mount may be an accessory rail. The base of the optic mount includes a first and a second end and a portion of the accessory rail may extend beyond the first end of the base away from the second end of the base. The mount may include two or more rings. The mount may be configured to offset the optic between 12 degrees and 22 degrees from vertical alignment with the barrel of the firearm when the firearm is in the vertical position. The mount may include a rear sight connected to the base. The rear sight may be horizontally aligned with a front sight of the firearm when the firearm is in the vertical position.

One embodiment is a firearm optics system. The firearm optics system includes a base configured to connect to a firearm and a support that extends away from the base. The firearm optics system includes an optic mount at the end of the support and an optic connected to the optic mount. The support is configured to position the optic connected to the optic mount offset from vertical alignment with a barrel of the firearm when the firearm is in the vertical position. The support is configured to offset the optic between 5 degrees and 30 degrees from vertical alignment with the barrel of the firearm when the firearm is in the vertical position.

The optic of the firearm optics system may include a red dot. The red dot may be vertically aligned with a centerline of a bore of the barrel of the firearm when the firearm is rotated to position the optic vertically with respect to the barrel. The support may be configured to offset the optic between 12 degrees and 22 degrees from vertical alignment with the barrel of the firearm when the firearm is in the vertical position. The optic may include a tritium fiber optic illuminated reticle. The firearm optics system may include a rear sight connected to the base, wherein the rear sight is horizontally aligned with a front sight of the firearm when the firearm is in the vertical position. The optic of the firearm optics system may include a reticle, wherein a center point of the reticle is vertically aligned with a centerline of a bore of the barrel of the firearm when the firearm is rotated to position the optic vertically with respect to the barrel.

One embodiment is a firearm. The firearm includes a barrel having a bore with a centerline. The firearm includes a receiver having a top and a bottom, the receiver being connected to the barrel. The firearm includes a rail connected to the top of the receiver. The firearm includes an optic mounted to the rail, wherein the optic is offset between 5 degrees and 30 degrees from vertical alignment with a barrel of the firearm when the firearm is in the vertical position.

The optic of the firearm may be the primary optic of the firearm. The optic of the firearm may be the only optic connected to the firearm. The firearm may include a handguard connected to the barrel, wherein optic is mounted on the handguard. The firearm may include a base connected to the rail, a canted support that connects the optic to the base, and a rear sight connected to the base. The rear sight may be horizontally aligned with a front sight of the firearm when the firearm is in the vertical position. The firearm may include a rear sight and a front sight, wherein the optic is canted to enable a clear line of sight between the rear sight and the front sight. The optic may be offset between 12 degrees and 22 degrees from vertical alignment with the barrel of the firearm when the firearm is in the vertical position.

Figure 1:
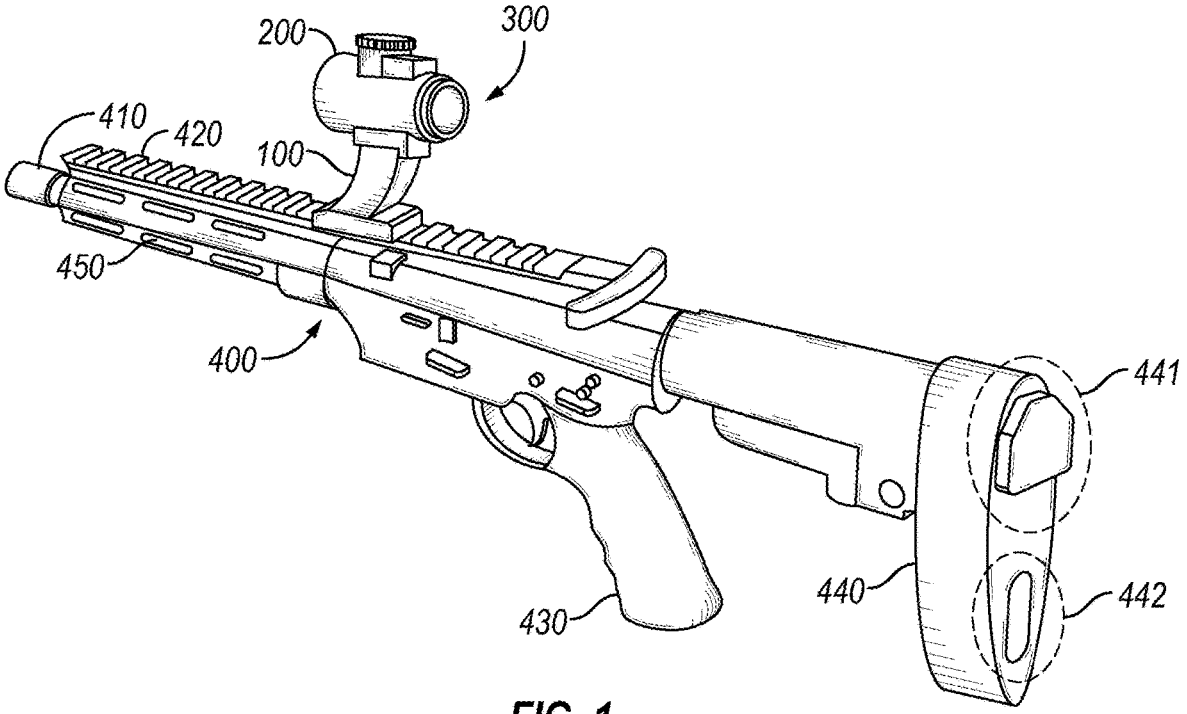
FIG. 1 shows an optic mounted to a rail on top of a firearm via an embodiment of an optics mount with the firearm in a substantially vertical position.

While the disclosure is susceptible to various modifications and alternative forms, specific examples have been shown by way of example in the drawings and will be described in detail herein. However, it should be understood that the disclosure is not intended to be limited to the particular forms disclosed. Rather, the intention is to cover all modifications, equivalents and alternatives falling within the scope of the disclosure.

DETAILED DESCRIPTION

As discussed herein, holding the butt of a firearm, such as a rifle, short barreled rifle, or pistol AR to the end of the humerus bone (i.e., the shoulder) may not be the most comfortable configuration for holding a firearm, such as an ARIS. For example, when holding a firearm in the vertical orientation the user's elbows are typically tucked in towards the body with the head tilted to use an optical device or sights positioned on top of the firearm. This orientation of the user creates a path of muscular tension which may run along the outside of the user's arm to the shoulder of the user. Tension is also created in the trapezius muscles of the user, specifically the base of the neck on the firing side of the body.

The minor canting of the firearm at an angle between 5 and 30 degrees facilitates the following potential benefits for the user. One benefit is causing the primary elbow joint to extend away from the body, which causes the tension line to move to the inside of the user's arm and into the body, which may create a more direct line of tension from the firearm to the user's center of gravity, creating a more stable body position, as well as allowing the user to manipulate the firearm more effectively. Another potential benefit of canting the firearm is that it allows the user to grasp the firearm with increased surface contact with the support hand, which improves the user's control of the firearm. One potential benefit of canting the firearm is that is allows the user to maintain a more "heads up" posture (i.e., maintaining a more upright head position). This posture potentially eliminates the tension in the trapezius muscles created from tilting the head. This more natural head positioning also potentially allows a user to operate the firearm more comfortably and naturally. The compilation of these benefit gained by canting the firearm between 5 and 30 degrees facilitates a firearm user to interface with the firearm in a biomechanically natural position. This biomechanically natural position allows the user to acquire a target faster through the aiming optic, as well as improve his/her shooting's accuracy. In a tactical scenario (i.e., a SWAT team searching for a violent suspect inside a building), the target acquisition speed and accuracy gained from the utilization of a canted optic mount can be the difference between the life and death of the user. These benefits are even more pronounced when the user is operating in a dynamic scenario (i.e., shooting while moving)

A more comfortable and/or ergonomical operation of a firearm, such as an ARIS rifle, is when the user cants (i.e., pivots or rotates) the top surface of the firearm towards the body so that an upper portion of the butt stock is inside of the shoulder and towards the clavicle. The depression in the clavicle area adjacent to the shoulder provides for a natural pocket against which to secure the butt stock of the firearm. Pivoting or canting the firearm in such a direction causes the elbows to extend outward or away from the body in comparison to operating the firearm in the normal vertical position, which may provide better balance and/or comfort for tactical personnel. However, rotating or canting the firearm in this manner makes it more difficult, if not impossible, for the user to use an optic or even the sights located on the top rail or surface of the firearm. Pivoting or canting the firearm is such a direction rotates the firearm's upper and lower receivers out of the line of sight, which may provide for better peripheral vision and/or situational awareness.

The position of the optic device at a canted location between 5 and 30 degrees offset from the central axis of the firearm may move the optic out of the line of sight between the front iron sight and rear iron sight. This allows a user the immediate use of the iron sights in the event that the optic becomes damaged or unusable. In a tactual environment (i.e., an active firefight in military combat), this access to the iron sights and the ensuing ability to immediately and accurately aim at targets may be the difference between the life and death of the user FIG. I shows a perspective view of a firearm optics system 300 connected to a firearm 400. The firearm 400 includes a barrel 410, a handguard 450, an accessory rail 420 located on the top of the handguard 450, a pistol grip 430, and a butt stock 440. The butt stock 440 includes an upper portion 441 and a lower portion 442. The firearm 400 may be more comfortable to operate if canted toward the user when held against the body so the upper portion 441 is cradled within the natural pocket in the clavicle area adjacent to the shoulder.

An optic device 200 is connected to the firearm 400 via a canted mount 100. The canted mount 100 is configured to offset the optic device 200 from the vertical centerline of the firearm 400 when the firearm 400 is in a vertical position as discussed herein. The firearm 400 shown in the figures is an ARIS. However, the firearm optics system 300 may be used to offset an optic device 200 on various firearms as would be recognized by one of ordinary skill in the art having the benefit of this disclosure.

Figure 2:
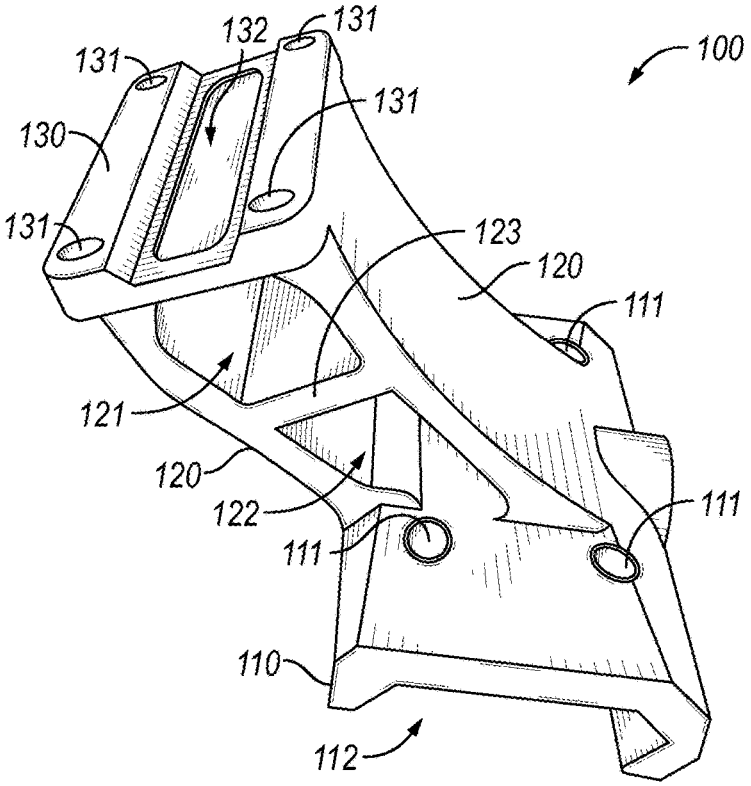
FIG. 2 shows an embodiment of a canted optics mount.

FIG. 2 shows an embodiment of a mount 100 of this disclosure. The mount 100 includes a base 110, a support 120 that extends from the base 100, and an optic mount 130 at the end of the support 120. Various optic mounts 130 may connected to the support 120 to connect to various optic devices 200 as would be appreciated by one of ordinary skill in the art having the benefit of this disclosure. The base 110 includes a channel 112 for connecting the mount 100 to an accessory rail 420 on a firearm 400. The channel 112 may be varied to accommodate different accessory rails as would be appreciated by one of ordinary skill in the art having the benefit of this disclosure. The base 110 includes a plurality of apertures 111 that enable the passage of a tool, which may be used to secure the base 110 to a firearm 400 and/or optic 200 to the mount 100.

The support 120 extends away from the base 110. The support 120 is canted to position an optic device 200 (not shown in FIG. 2) offset from the vertical axis of a firearm 400 when the firearm 400 is vertically positioned as discussed herein. The support 120 includes an upper opening 121 and a lower opening 122 with a cross member 123 positioned between the upper opening 121 and lower opening 122. The size, shape, and/or configuration of the support 120 may be varied as would be appreciated by one of ordinary skill in the art having the benefit of this disclosure. For example, the support 120 may be solid or have more or less openings 121, 122 and cross members 123.

An optics mount 130 is positioned at the upper end of the support 120. The optics mount 130 is configured to connect to an optic device 200, such as, but not limited to, a red dot, an advance combat optical gunsight (ACOG), a reflex sight, a scope, or the like. For example, the optics mount 130 may comprise two or more scope rings to connect to a scope. The optics mount 130 includes apertures 131 to enable the insertion of fasteners to securely fasten an optic device 200 to the optics mount 130. The optics mount 130 may include groove 132. As discussed herein, the support 200 is canted to offset the optic device 200 with respect to the vertical axis of the firearm 400 when the firearm 400 is in a vertical position. The base 110, the support 120, and the optics mount 130 may comprise a unitary structure. Alternatively, the base 110 may be connected to the support 120 and the support 120 may be connected to the optics mount 130. The size, shape, and for configuration of the mount 100 may be varied as would be appreciated by one of ordinary skill in the art having the benefit of this disclosure. For example, the size, shape, number, and/or configurations of apertures 111, apertures 131, and groove 132 may be varied.

The optics mount 130 may be configured in various ways to enable an optic 200 to be connected to the mount 100. For example, in one embodiment the optics mount 130 of the mount 100 may be a rail configured to be connected to an optic device 200. For example, the optic mount 130 may comprise a picatinny rail to which an optic 200 may be connected. The mount 100 may be used as an adapter to connect an optic 200 to a firearm 400 that does not include the requisite rail to which the optic 200 needs to be connected to.

Figure 3:
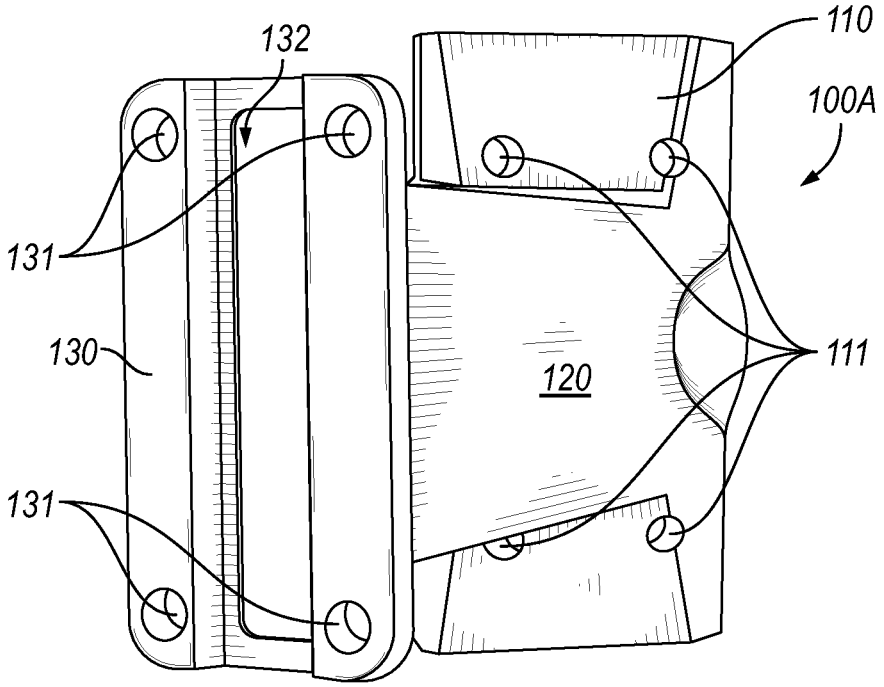
FIG. 3 shows an embodiment of a canted optics mount.

FIG. 3 shows an embodiment of a mount 100A of this disclosure. The mount 100A includes a base 110, a support 120 that extends from the base 100, and an optic mount 130 at the end of the support 120. Various optic mounts 130 may connected to the support 120 to connect to various optic devices 200 as would be appreciated by one of ordinary skill in the art having the benefit of this disclosure. The base 110 may include a channel for connecting the mount 100 to an accessory rail 420 on a firearm 400. The base 110 includes a plurality of apertures 111 to enable the passage of a tool as discussed herein.

The support 120 extends away from the base 110. The support 120 is canted to position an optic device 200 (not shown in FIG. 2) offset from the vertical axis of a firearm 400 when the firearm 400 is vertically positioned as discussed herein. The size, shape, and/or configuration of the support 120 may be varied as would be appreciated by one of ordinary skill in the art having the benefit of this disclosure.

An optics mount 130 is positioned at the upper end of the support 120. The optics mount 130 is configured to connect to an optic device 200, such as, but not limited to, a red dot, an ACOG, a reflex sight, a scope, or the like. The optics mount 130 includes apertures 131 to enable the insertion of fasteners to securely fasten an optic device 200 to the optics mount 130. As discussed herein, the support 120 and optic mount 130 are canted to offset the optic device 200 with respect to the vertical axis of the firearm 400 when the firearm 400 is in a vertical position. The base 110, the support 120, and the optics mount 130 may comprise a unitary structure. Alternatively, the base 110 may be connected to the support 120 and the support 120 may be connected to the optics mount 130.

Figure 4:
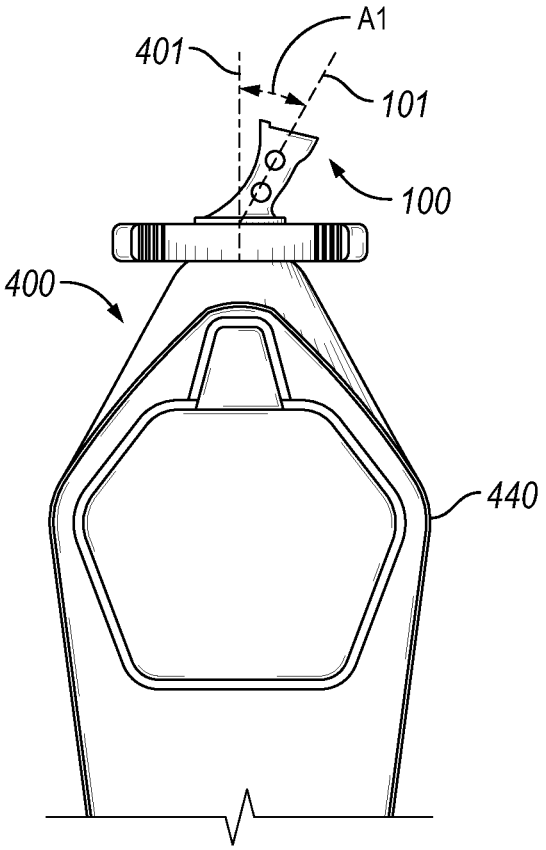
FIG. 4 shows a rear view of a firearm in substantially vertical position with an optics mount connected to the top of the firearm.

FIG. 4 shows a rear view of a firearm 400 that is positioned in a substantially vertical position. A mount 100 connected to the top of the firearm 400. Preferably, the mount 100 may be connected to top of a receiver of the firearm 400. As shown, the mount 100 is canted creating an angle A1 between the vertical axis 401 of the firearm 400 and the centerline 101 of the mount 100 with respect to the top of the firearm 400. The A1 may be varied between 5 degrees and 30 degrees. Depending on the angle A1, a user of the firearm 400 may be able to use front and rear sights with the firearm 400 is vertically positioned. In an embodiment, the angle A1 may be between 7.5 and 23 degrees. In an embodiment, the angle A1 may be between 8 and 23 degrees. In an embodiment, the angle A1 may be between 15 and 25 degrees. In an embodiment, the angle A1 may be between 20 and 25 degrees. In a preferred embodiment, the angle A1 may be between 12 and 22 degrees. The angle A1 may vary based on the type of firearm, the type of optics, the height of the shooter, the arm length of the shooter, other dimensions of the shooter, and/or the like as would be appreciated by one of ordinary skill in the art having the benefit of this disclosure. Preferably, angle A1 would not be substantially greater than 30 degrees as such an angle would necessitate the cant or rotation of the butt stock of a rifle to an uncomfortable position when holding the rifle against the shoulder area of a user. In some embodiments, the optimal angle A1 may be 25 degrees or less depending on the type of the firearm, the type of the optics, the height of the user, the arm length of the user, and/or the like as would be appreciated by one of ordinary skill in the art having the benefit of this disclosure.

Figure 5:
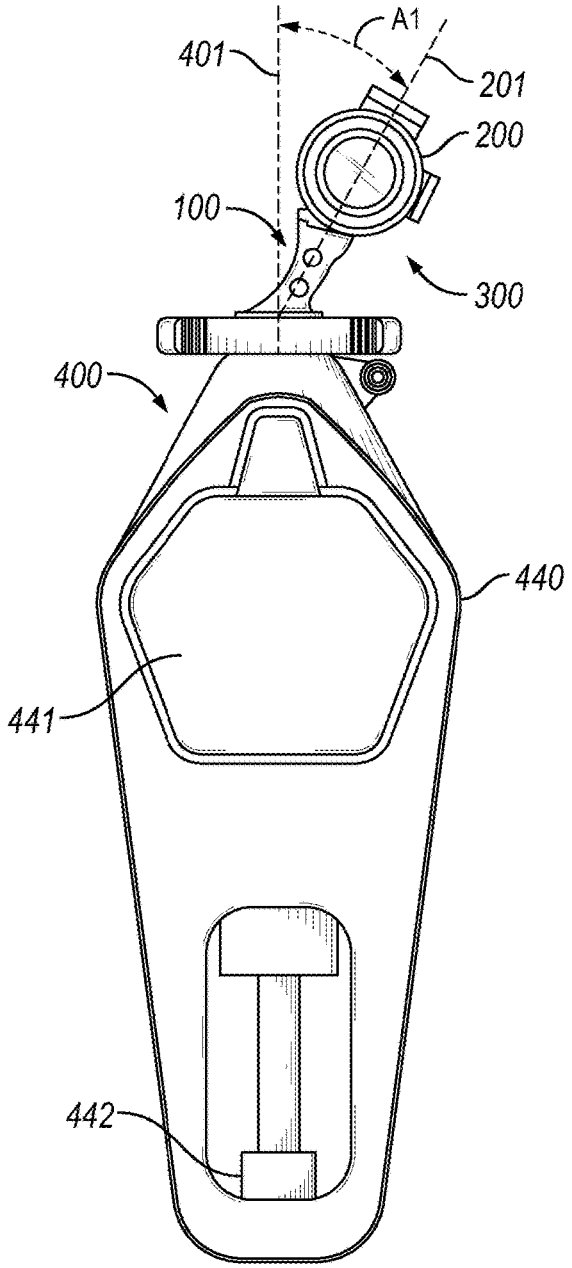
FIG. 5 shows a rear view of a firearm in a substantially vertical position with an optic mounted to the top of the firearm via a canted optics mount.

FIG. 5 shows a rear view of a firearm 400 that is positioned in a substantially vertical position. A firearm optics system 300 including a mount 100 and an optic device 200 is connected to the top of the firearm 400. As shown, the mount 100 of the firearm optics system 300 is canted creating an angle A1 between the vertical axis 401 of the firearm 400 and the centerline 201 of the optic device 200. The angle A1 may be varied between 5 degrees and 30 degrees. Depending on the angle A1, a user of the firearm 400 may be able to use front and rear iron sights with the firearm 400 is vertically positioned. In an embodiment, the angle A1 may be between 12 and 22 degrees.

Figure 6:
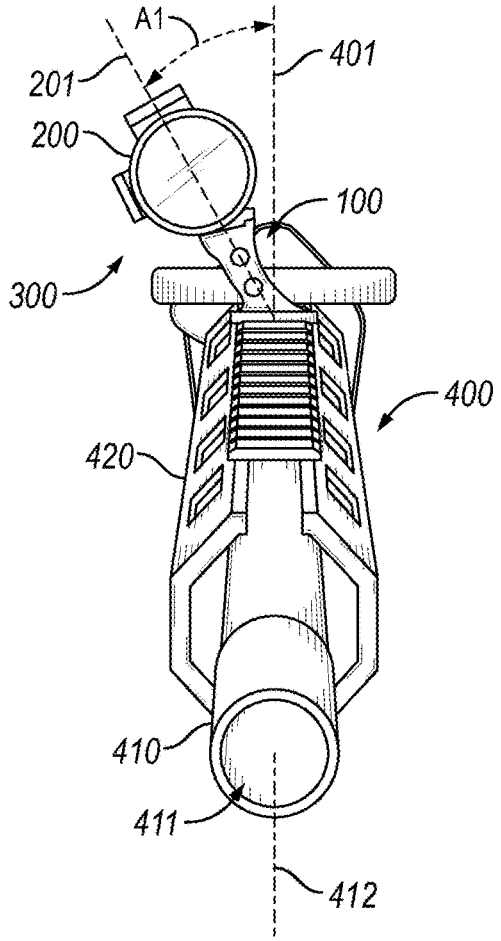
FIG. 6 shows a front view of a firearm with an optic mounted to the top of the firearm via a canted optics mount.

FIG. 6 shows a front view of a firearm 400 in a substantially vertical position. A firearm optics system 300 including a mount 100 and an optic device 200 connected to the top of the firearm 400. As shown, the mount 100 of the firearm optics system 300 is canted creating an angle A1 between the vertical axis 401 of the firearm 400 and the centerline 201 of the optic device 200. The angle A1 may be varied between 5 degrees and 30 degrees. Depending on the angle A1, a user of the firearm 400 may be able to use front and rear sights with the firearm 400 is vertically positioned. In an embodiment, the angle A1 may be between 12 and 22 degrees. The barrel 410 of the firearm 400 includes a bore 411 with a centerline 412 that runs the length of the bore 411.

Figure 7:
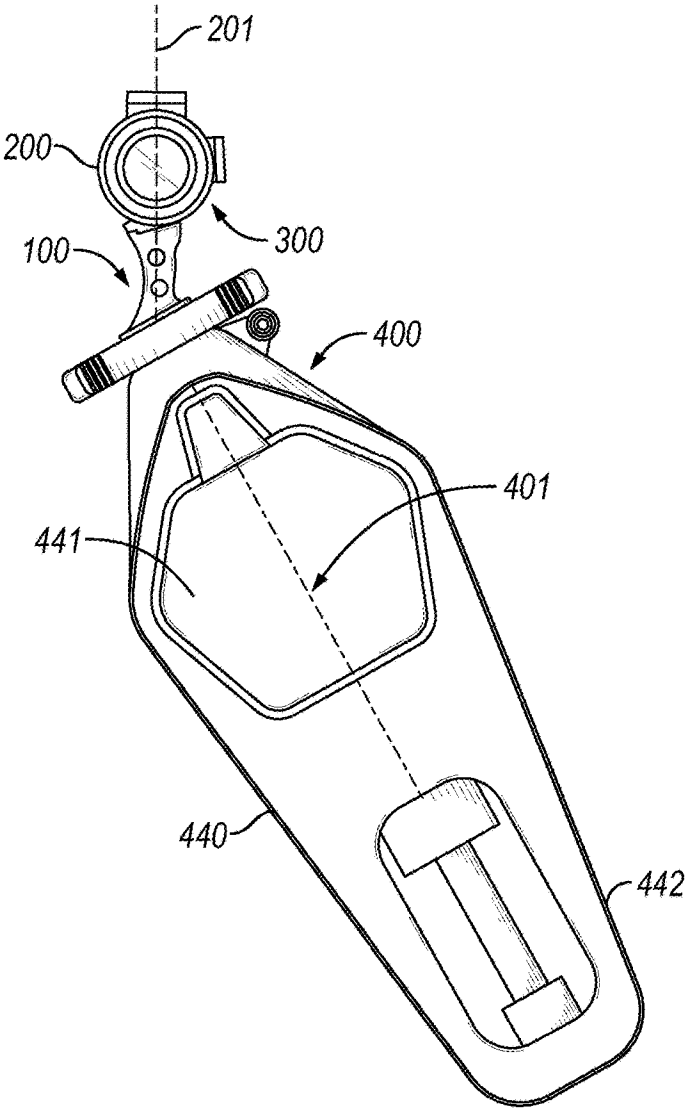
FIG. 7 shows a firearm canted so that the optic is vertically aligned with the bore of the barrel of the firearm.
Figure 10:
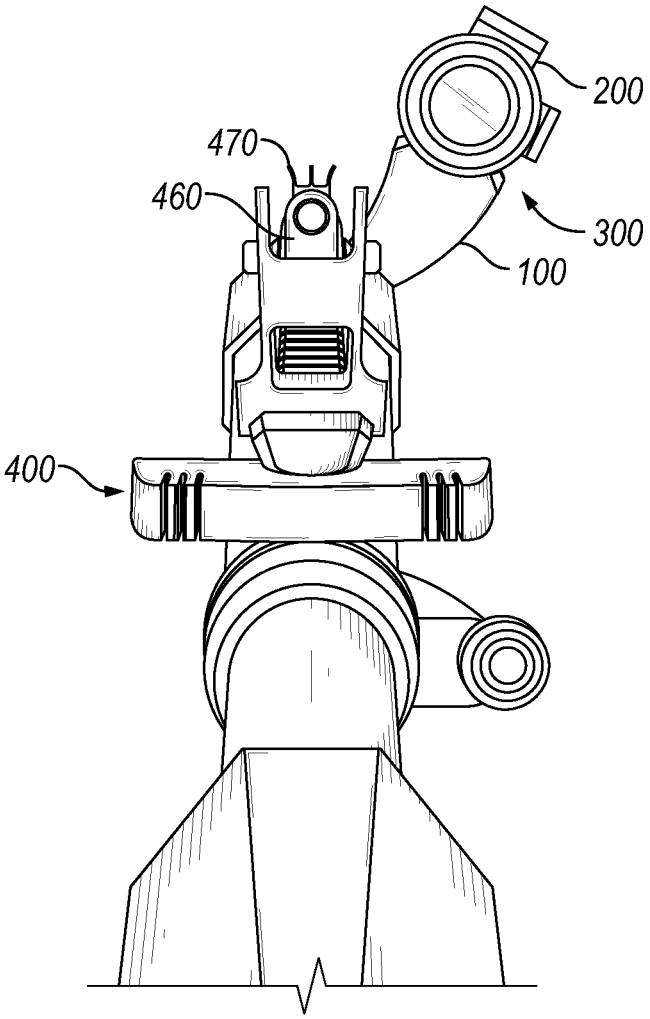
FIG. 10 shows a firearm in a substantially vertical position with a mount that offsets an optic.

FIG. 7 shows a rear view of a firearm 400 in a canted position. The firearm 400 is canted so that an upper portion 441 of the butt stock 440 is rotated toward the user (not shown) with the lower portion 442 of the butt stock 440 rotated away from the user. As discussed herein, canting the firearm 400 in this way may, among other things, make it more comfortable to hold the firearm 400 as the upper portion 441 of the butt stock 400 is moved off the end of humerus bone at the shoulder and is, instead, cradled in the natural pocket adjacent to the clavicle area.

A firearm optics system 300 is connected to the upper surface of the firearm 400. The mount 100 is canted so that the optic device 200 is positioned vertically with respect to the firearm 400 when the firearm 400 is canted as shown. In other words, the centerline 201 of the optic device 200 is vertically positioned and aligned with the centerline 412 of the bore 411 of the barrel 410. As discussed above, the support 120 of the mount 100 is configured to offset the optic device 200 by an angle A1 (shown in FIGS. 5 and 6) from the vertical axis 401 of the firearm 400 when the firearm 400 is substantially vertically positioned. The angle A1 corresponds to the angle the firearm 400 is canted to position the upper portion 441 of the butt stock 440 in a comfortable position against the clavicle area of the user's shooter. The degree of cant may vary on the length of the firearm 400, the height of the user, and/or other dimensions of the user. Thus, the angle A1 may vary between 5 degrees and 30 degrees. In a preferred embodiment, the angle A1 may be between 12 and 22 degrees. Although FIG. 7 shows a cant of the firearm 400 in a counter-clockwise direction, which would be for a right-handed shooter, the firearm 400 may be canted in a clockwise direction for a left-handed shooter as would be appreciated by one of ordinary skill in the art having the benefit of this disclosure. For a left-handed shooter, the support 120 of the mount 100 would be configured to cant the optic device 200 in an angle A1 to the left of the firearm 400 (when viewing from the rear of the firearm 400) instead of to the right as shown in FIGS. 4 and 5. The mount 100 could be reversible so that it could be used to cant an optic device 200 to the right or the left of the firearm 400 depending on whether the user was right-handed or left-handed.

Figure 8:
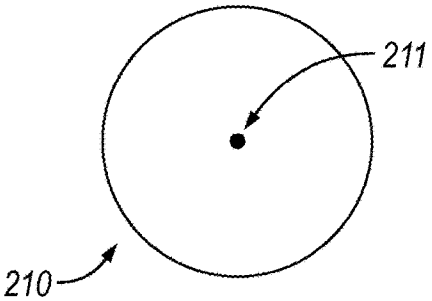
FIG. 8 is a schematic of an embodiment of a view through an optic.
Figure 9:
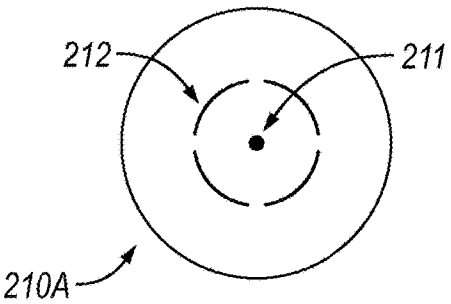
FIG. 9 is a schematic of an embodiment of a view through an optic.

FIG. 8 is a schematic 210 of a red dot 211 for an example optic device 200 that may be used with the firearm optics system 300 of the present disclosure. FIG. 9 is a schematic 210A showing a reticle 212 and a red dot 211 of an example optic device 200 that may be used with the firearm optics system 300 of the present disclosure. The mount 100 may be configured so that the red dot 211 of the optic device 200 is vertically aligned with the centerline 412 of the barrel 410 when the firearm 400 is in a canted position locating the optic device 200 vertically above the barrel 410. Depending on the firearm, the canted optic device 200 may not be vertically aligned with the centerline 412 of the barrel 410 when the firearm 400 is in a canted position locating the optic device 200 at a horizontal orientation above the firearm 400. For example, the firearm 400 may include an accessory rail 420 that is higher causing the optic device 200 to not be perfectly aligned with the centerline 412 of the barrel 410 when the firearm 400 is canted to position the optic device 200 in a position substantially above the firearm 400 to be utilized by a user of the firearm 400.

FIG. IO shows a firearm 400 in a substantially vertical position. A firearm optics system 300 is connected to the firearm 400. The canted mount 100 offsets the optic device 200 so that a user may use a rear sight 460 and a front sight 470 when the firearm 400 is in the substantially vertical position. If the optic device is damaged or not operating properly, the canted mount 100 that offsets the optic 200 enables a user to still use the sights 460, 470 on the firearm 400 to aim at a target.

Figure 11:
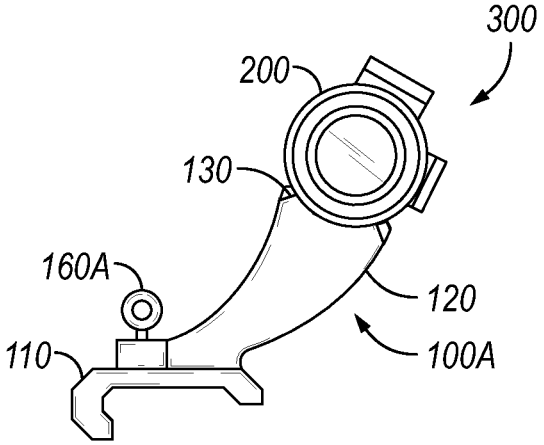
FIG. 11 shows an embodiment of an optic mounted to a canted optics mount with a rear sight connected to the base of the canted optics mount.

FIG. 11 shows a firearm optics system 300 including a mount 100 and an optic device 200 is connected to the mount 100. The mount 100 of the firearm optics system 300 is canted creating an angle between the vertical axis of a firearm and a centerline of the optic device as discussed herein. The mount 100 includes a base 110, a support 120 that extends from the base 100, and an optic mount 130 at the end of the support 120. The optic device 200 is connected to the mount 100 via the optic mount 130. The mount 100 includes a rear sight 160A that extends upwards from the base 110. The rear sight 160A may be aligned with a front sight of a firearm when the firearm is in a substantially vertical position. The rear sight 160A enables the firearm to be accurately aimed in a substantially vertical position. This may be desired if the optical device 200 that is canted away from the vertical position becomes damaged and/or is inoperable.

Figure 12:
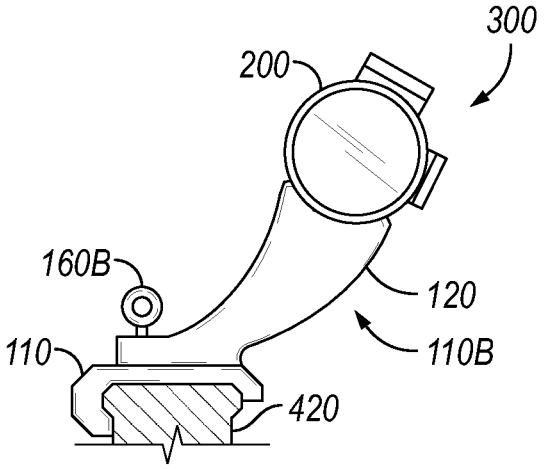
FIG. 12 shows an embodiment of an optic mounted to a canted optics mount with a rear sight connected to the base of the canted optics mount.

FIG. 12 shows a firearm optics system 300 including a mount 100 and an optic device 200 connected to the mount 100. The mount 100 of the firearm optics system 300 is canted creating an angle between the vertical axis of a firearm and a centerline of the optic device as discussed herein. The mount 100 includes a base 110, a support 120 that extends from the base 100, and an optic mount 130 at the end of the support 120. The optic device 200 is connected to the mount 100 via the optic mount 130. The mount 100 includes a rear sight 160B that extends upwards from the base 110. The rear sight 160B may be aligned with a front sight of a firearm when the firearm is in a substantially vertical position. The rear sight 160B enables the firearm to be accurately aimed in a substantially vertical position. This may be desired is the optical device 200 that is canted away from the vertical position becomes damaged and/or is inoperable.

Figure 13:
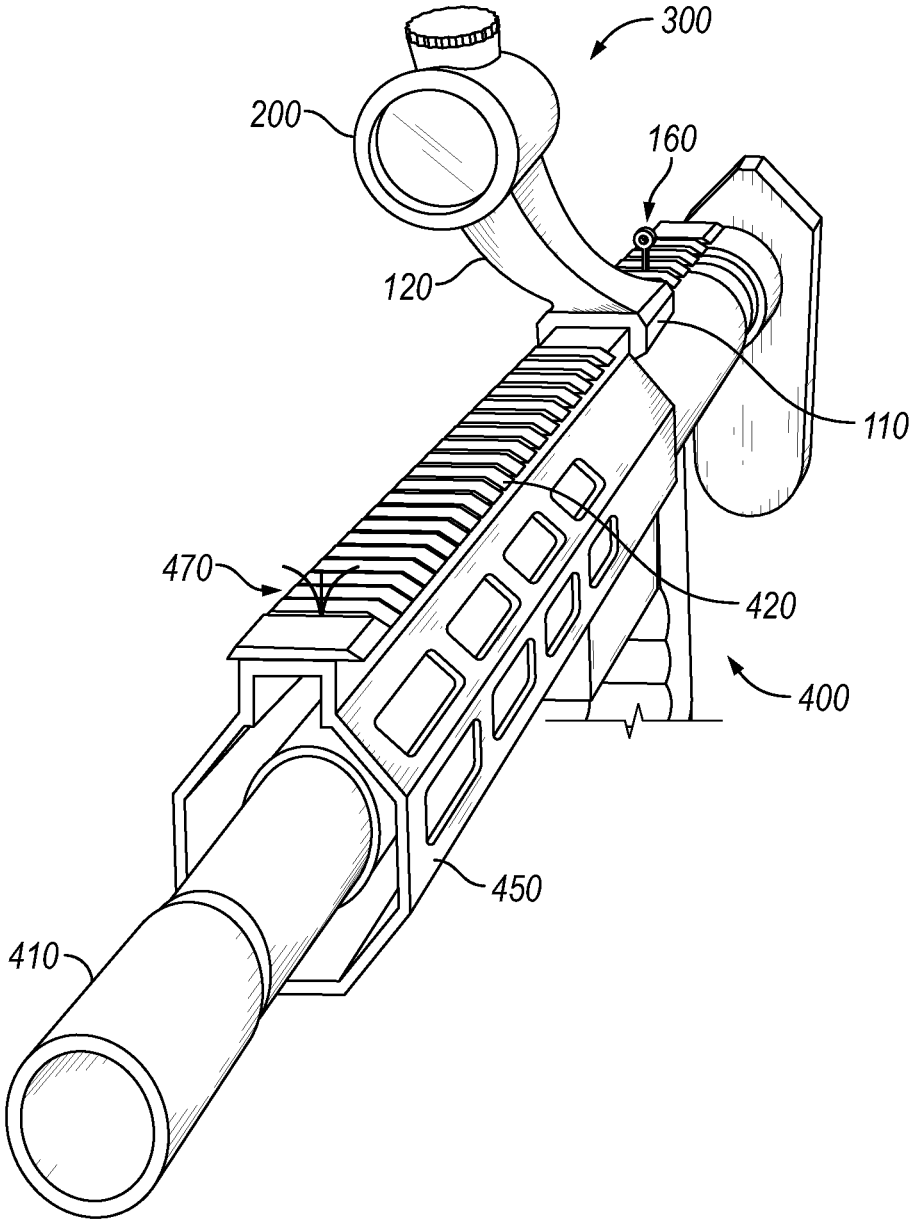
FIG. 13 shows an embodiment of a canted optics mount with a rear sight connected to a firearm.

FIG. 13 shows a firearm optics system 300 that includes a rear sight 160 connected to a firearm 400. The firearm optics system 300 includes a mount 100 and an optic device 200 is connected to the mount 100. The mount 100 of the firearm optics system 300 is canted creating an angle between the vertical axis of a firearm and a centerline of the optic device as discussed herein. The mount 100 includes a base 110, a support 120 that extends from the base 100, and an optic mount 130 at the end of the support 120. The optic device 200 is connected to the mount 100 via the optic mount 130. The firearm optics system 300 is connected to the firearm 400 via a rail 420 positioned on the upper surface of the firearm 400.

The mount 100 includes a rear sight 160 that extends upwards from the base 110. The rear sight 160 may be aligned with a front sight 470 of the firearm 400 when the firearm 400 is in a substantially vertical position. The rear sight 160 is aligned with the front sight 470 of the firearm 400 and enables the firearm 400 to be accurately discharged in a substantially vertical position. This may be desired is the optical device 200 that is canted away from the vertical position becomes damaged and/is inoperable.

Figure 14:
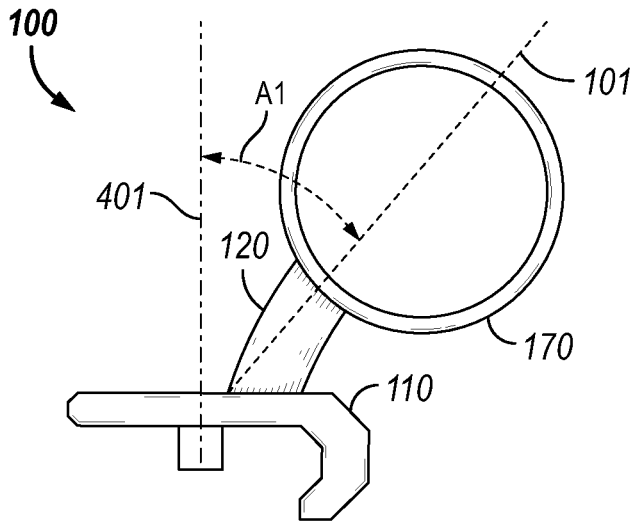
FIGS. 14-15 show an embodiment of a canted optics mount that includes scope nngs.
Figure 15:
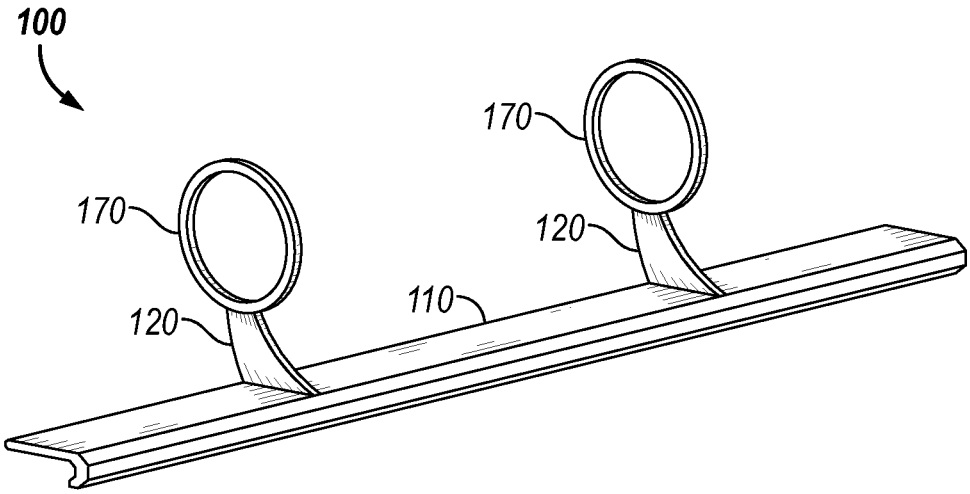
Figure 16:
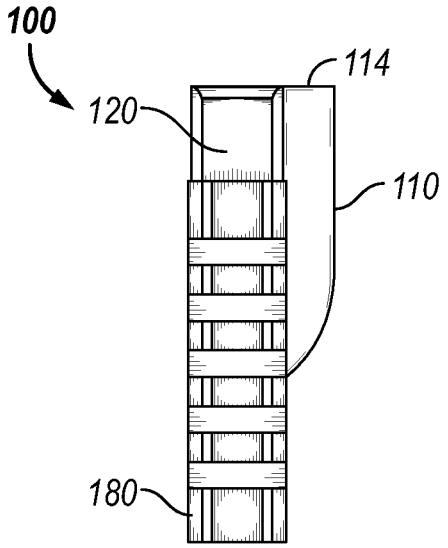
FIGS. 16-19 show an embodiment of a canted optics mount that includes a canted accessory rail for the connection of an optic to the mount.

FIGS. 14 and 15 show an embodiment of a canted optics mount 100 that includes scope rings 170. The mount 100 includes a base 110, a support 120 that extends from the base 100, and two scope rings 170 at the end of the support 120. Various scopes may be connected to canted optics mount 100 via the scope rings 170 as would be appreciated by one of ordinary skill in the art having the benefit of this disclosure. The base 110 includes a channel 112 for connecting the mount 100 to an accessory rail 420 on a firearm 400. The channel 112 may be varied to accommodate different accessory rails as would be appreciated by one of ordinary skill in the art having the benefit of this disclosure.

The support 120 extends away from the base 110. The support 120 is canted to position a scope (not shown in FIGS. 14 and 15) connected via the scope rings 170 to be offset from the vertical axis of a firearm 400 when the firearm 400 is vertically positioned as discussed herein. The size, shape, and/or configuration of the base 110, support 120, and scope rings 170 may be varied as would be appreciated by one of ordinary skill in the art having the benefit of this disclosure.

The mount 100 is canted such that when mounted to the top of a firearm it creates an angle A1 between the vertical axis 401 of the firearm (not shown in FIGS. 14 and 15) and the centerline 101 of the mount 100. The angle A1 may be varied between 5 degrees and 30 degrees. With scope rings 170, the angle A1 may preferably be between approximately 5 and 15 degrees. Depending on the angle A1, a user of the firearm 400 may be able to use front and rear sights with the firearm 400 is vertically positioned even when a scope is attached to the mount 100.

FIGS. 16-19 show an embodiment of a canted optics mount 100. The canted optics amount 100 includes a base 110, a support 120 that extends from the base 100, and an accessory rail 180 connected to the end of the support 120. Various optical device may be connected to canted optics mount 100 via the accessory rail 180 as would be appreciated by one of ordinary skill in the art having the benefit of this disclosure. The accessory rail 180 may be, but is not limited to, a picatinny rail. The base 110 includes a channel 112 for connecting the mount 100 to an accessory rail 420 on a firearm 400. The channel 112 may be varied to accommodate different accessory rails as would be appreciated by one of ordinary skill in the art having the benefit of this disclosure. The base 110 includes a plurality of apertures 111 that may be threaded to enable fasteners to secure the base 110 to a rail 420 of a firearm 400.

The support 120 extends away from the base 110 and is canted to position an optical device (not shown in FIGS. 16-19) connected via the accessory rail 180 to be offset from the vertical axis of a firearm when the firearm is vertically positioned as discussed herein. The size, shape, and/or configuration of the base 110, support 120, and accessory rail 180 may be varied as would be appreciated by one of ordinary skill in the art having the benefit of this disclosure. For example, the base 110, support 120, and accessory 180 may be formed as an integral component. Additionally, the support 120 may be merely a canted surface on the base 110 as would be appreciated by one of ordinary skill in the art having the benefit of this disclosure.

The mount 100 is configured to be connected to the top of the firearm 400. As shown, the support 120 is canted as well as the accessory rail 180 that is connected to the support. Thus, the mount creates an angle between the vertical axis of the firearm and the centerline of the optical device as discussed herein. The angle is with respect to the top of the firearm. The angle may be varied between 5 degrees and 30 degrees. Depending on the angle, a user of the firearm may be able to use front and rear sights with the firearm is vertically positioned. In an embodiment, the angle A1 may be between 7.5 and 23 degrees. In an embodiment, the angle A1 may be between 10 and 20 degrees. In an embodiment, the angle A1 may be between 15 and 25 degrees. In an embodiment, the angle A1 may be between 20 and 25 degrees. In a preferred embodiment, the angle A1 may be between 12 and 22 degrees. The angle may vary based on the type of firearm, the type of optics, the height of the shooter, the arm length of the shooter, other dimensions of the shooter, and/or the like as would be appreciated by one of ordinary skill in the art having the benefit of this disclosure.

Figure 17:
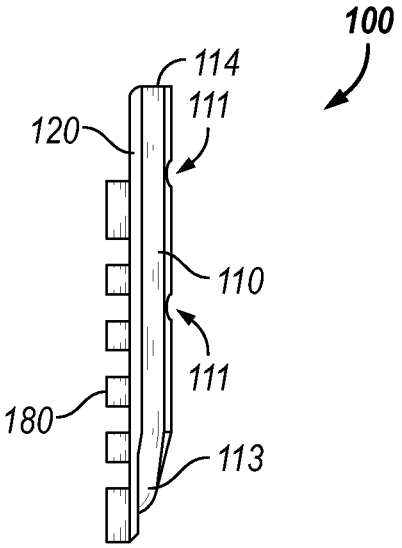
Figure 18:
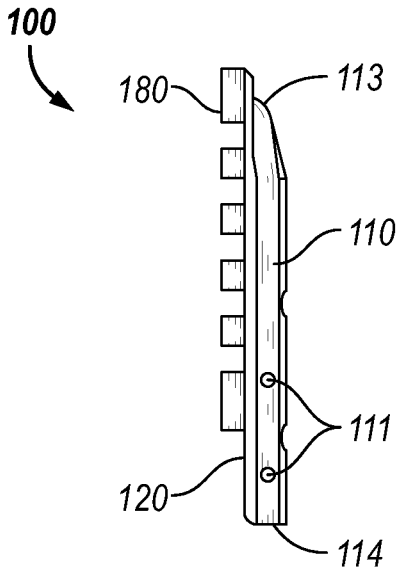
Figure 19:
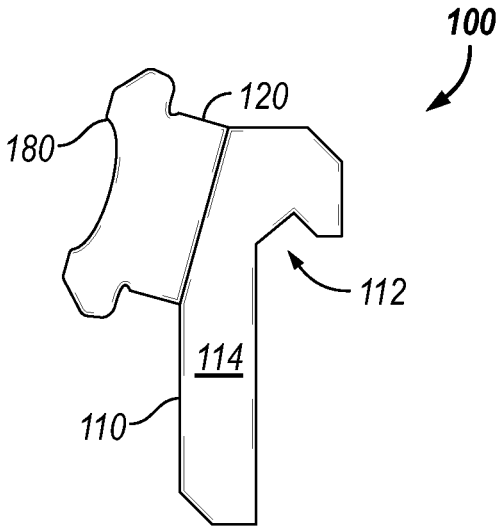

The base 110 includes a first end 113 and a second end 114. A portion of the accessory rail 180 may extend beyond the first end 113 away from the second end 114 as shown in FIGS. 17 and 18. This configuration of the base 110, support 120, and accessory rail 180 enables the optical device to be pushed forward with respect to the user.

Although various examples have been shown and described, the present disclosure is not so limited and will be understood to include all such modifications and variations as would be apparent to one skilled in the art.

The invention claimed is:

1. A mount comprising:

a base configured to secure to a firearm above a barrel of said firearm when said firearm is in a vertical position;

a first support secured to said base at a proximal end of said first support, wherein said first support extends away from said base;

a first ring secured to a distal end of said first support and configured to secure a rifle scope, wherein said first support positions said first ring in a way such that a first centerline extending from said proximal end of said first support through a center of said first ring is offset at an angle between 5 degrees and 30 degrees from a vertical axis of said firearm when said firearm is in said vertical position;

a second support secured to said base at a proximal end of said second support, wherein said second support extends away from said base; and a second ring secured to a distal end of said first support and configured to secure said rifle scope, wherein said second support positions said second ring in a way such that a second centerline extending from said proximal end of said second support through a center of said second ring is offset at an angle between 5 degrees and 30 degrees from said vertical axis of said firearm when said firearm is in said vertical position.

2. The mount of claim 1, wherein an optics line extending from said center of said first ring to said center of said second ring is substantially parallel with a bore of said barrel when said base is secured to said firearm.

3. The mount of claim 1, further comprising a rear sight connected to said base.

4. The mount of claim 3, wherein said rear sight is configured to horizontally align with a front sight of said firearm when said firearm is in said vertical position.

5. The mount of claim 1, wherein said base comprises a first end and a second end, wherein said first support is secured to said base closer to said first end, wherein said second support is secured to said base closer to said second end.

6. The mount of claim 5, wherein said first end is closer to a buttstock of said firearm and said second end is closer to a muzzle of said firearm.

7. The mount of claim 1, further comprising a first cantilevered member and a second cantilevered member of said first support and said second support.

8. The mount of claim 7, further comprising a cross member connecting said first cantilevered member and said second cantilevered member of said first support and said second support.

9. The mount of claim 8, wherein said base, first cantilevered member, second cantilevered member, and cross member create an upper passage and a lower passage.

10. The mount of claim 9, wherein said upper passage and said lower passage extend in a parallel direction relative to said barrel.

11. A mount comprising:

a base configured to secure to a firearm above a barrel of said firearm when said firearm is in a vertical position, wherein said base comprises a channel configured to engage with an accessory rail of said firearm;

at least two supports secured to said base at proximal ends, wherein said at least two supports are spaced apart about said base, wherein said at least two supports extend away from said base; and at least two rings secured to said at least two supports at distal ends of said at least two supports, wherein said at least two rings are configured to secure a rifle scope, wherein said at least two supports are configured to position said at least two rings in a way such that centerlines extending from said proximal ends of said at least two supports through centers of said at least two rings secured to said at least two supports are offset at angles between 5 degrees and 30 degrees from a vertical axis of said firearm when said firearm is in said vertical position, wherein an optics line extending through said centers of said at least two rings is substantially parallel with a bore of said barrel when said base is secured to said firearm.

12. The mount of claim 11, further comprising a rear sight connected to said base.

13. The mount of claim 12, wherein said rear sight is configured to horizontally align with a front sight of said firearm when said firearm is in said vertical position.

14. The mount of claim 11, further comprising a first cantilevered member and a second cantilevered member of said at least two supports.

15. The mount of claim 14, further comprising a cross member connecting said first cantilevered member and said second cantilevered member of said at least two supports.

16. The mount of claim 15, wherein said base, first cantilevered member, second cantilevered member, and cross member create an upper passage and a lower passage.

17. A mount comprising:

a base configured to secure to a firearm above a barrel of said firearm when said firearm is in a vertical position, wherein said base comprises a channel configured to engage with an accessory rail of said firearm;

a first pair of cantilevered members secured to said base at proximal ends of said first pair of cantilevered members, wherein said first pair of cantilevered members extends away from said base;

a first ring secured to distal ends of said first pair of cantilevered members and configured to secure a rifle scope, wherein said first pair of cantilevered members is configured to position said first ring in a way such that a first centerline extending from said proximal ends of said first pair of cantilevered members through a center of said first ring is offset at an angle between 5 degrees and 30 degrees from a vertical axis of said firearm when said firearm is in said vertical position;

a second pair of cantilevered members secured to said base at proximal ends of said second pair of cantilevered members, wherein said second pair of cantilevered members extends away from said base; and a second ring secured to distal ends of said second pair of cantilevered members and is configured to secure said rifle scope, wherein said second pair of cantilevered members is configured to position said second ring in a way such that a second centerline extending from said proximal ends of said second pair of cantilevered members through a center of said second ring is offset at an angle between 5 degrees and 30 degrees from said vertical axis of said firearm when said firearm is in said vertical position, wherein an optics line extending from said center of said first ring to said center of said second ring is substantially parallel with a bore of said barrel when said base is secured to said firearm.

18. The mount of claim 17, further comprising a rear sight connected to said base, wherein said rear sight is configured to horizontally align with a front sight of said firearm when said firearm is in said vertical position.

19. The mount of claim 18, further comprising a first cross member connecting said first pair of cantilevered members and a second cross member connecting said second pair of cantilevered members.

20. The mount of claim 17, wherein said base, first pair of cantilevered members, and first cross member create a first upper passage and a first lower passage, wherein said base, second pair of cantilevered members, and second cross member create a second upper passage and a second lower passage, wherein said first upper passage, second upper passage, first lower passage, and second lower passage extend in a direction that is generally aligned with said barrel.

* * * * *